United States Patent [19]

Im

[11] Patent Number: 4,563,048

[45] Date of Patent: Jan. 7, 1986

[54] LOCKING DEVICE FOR AN ELECTRICAL PLUG

[76] Inventor: Kwan S. Im, 5155 W. Winona, Chicago, Ill. 60630

[21] Appl. No.: 690,595

[22] Filed: Jan. 11, 1985

[51] Int. Cl.[4] ..... H01R 13/44

[52] U.S. Cl. ..... 339/37

[58] Field of Search ..... 339/37, 82

[56] References Cited

U.S. PATENT DOCUMENTS

| | | | |
|---|---|---|---|
| 2,643,787 | 6/1953 | Rockman | 220/3.2 |
| 2,654,073 | 9/1953 | Katz | 339/37 |
| 2,664,734 | 1/1954 | McEneaney | 70/57 |
| 2,733,416 | 1/1956 | Evalt | 339/37 |
| 2,955,272 | 10/1960 | Gallardo | 339/37 |
| 3,345,600 | 10/1967 | Scherer | 339/37 |
| 3,416,123 | 12/1968 | Husebo | 339/37 |
| 3,539,968 | 11/1970 | Tunstall et al. | 339/37 |
| 3,543,544 | 12/1970 | Efston | 70/57 |
| 3,781,913 | 12/1973 | Liburdi | 339/37 |
| 4,025,140 | 5/1977 | Matys | 339/37 |
| 4,407,554 | 10/1983 | Drall | 339/37 |
| 4,413,488 | 11/1983 | Harmison, Jr. | 339/37 |

FOREIGN PATENT DOCUMENTS

| | | |
|---|---|---|
| 2117818 | 10/1972 | Fed. Rep. of Germany . |
| 1354173 | 6/1964 | France . |

OTHER PUBLICATIONS

"Short Cut and Tips", p. 185, *Popular Science,* Aug. 1958, —Lock Kidproofs Power Tool.

*Primary Examiner*—Gil Weidenfeld
*Assistant Examiner*—Paula Austin
*Attorney, Agent, or Firm*—John C. Shepard

[57] ABSTRACT

A locking device for an electrical plug includes a lock having a shackle sized to fit through the prong apertures of the plug and an electrically nonconductive spacer disposed between the prongs through which the shackle passes.

9 Claims, 2 Drawing Figures

LOCKING DEVICE FOR AN ELECTRICAL PLUG

BACKGROUND OF THE INVENTION

1. Technical Field

This invention relates generally to a locking device and, more particularly, to a locking device for safely preventing the use of an electrical plug.

2. Background Art

It is often desirable to prevent the unauthorized use or misuse of electrical appliances, power tools, copiers, typewriters, or electronic equipment such as computers. By preventing this unauthorized use, damage to the equipment or injury to the user can be avoided. In the home, it might be desirable to prevent children from viewing television for extended periods of time.

In the prior art, many devices have been designed to prevent the use of electrical applicances by locking the plug on the end of the electrical cord so as to disable the plug and prevent its insertion into an electrical receptacle. Some of these devices have included a housing which could be closed over the entire plug and locked. Other devices have included a block into which the prongs of the electrical plug were inserted and locked therein. Devices of this type were complex and relatively expensive.

Simpler mechanisms have been constructed which take advantage of the aligned apertures in the plug prongs and employ conventional padlocks as locks. Examples of devices are shown in Scherer U.S. Pat. No. 3,345,600, Tunstall et al. U.S. Pat. No. 3,539,968, Drall U.S. Pat. No. 4,407,554, and Harmison, Jr. U.S. Pat. No. 4,413,488. However, the Scherer and Tunstall et al. constructions employ multiple components, while Drall and Harmison, Jr. do not prevent partial insertion of the plug prongs into a receptacle.

SUMMARY OF THE INVENTION

The present invention is directed to overcoming one or more of the problems as set forth above.

According to the present invention, a locking device includes a lock having a shackle adapted to pass through the prong apertures and a nonconductive spacer carried by the shackle between the prongs.

In an exemplary embodiment of the invention, the lock is a padlock wherein the free end of the shackle has a reduced diameter permitting insertion through the prong apertures and the spacer and the other end of the shackle has a more substantial diameter to provide strength.

In a preferred embodiment of the invention, the diameter of the nonconductive spacer is such that the spacer extends beyond the free ends of the plug prongs to prevent insertion of any part of the prongs into an electrical outlet.

BRIEF DESCRIPTION OF THE DRAWINGS

The details of construction and operation of the invention are more fully described with reference to the accompanying drawings which form a part hereof and in which like reference numerals refer to like numerals throughout.

In the drawings.

DESCRIPTION OF THE PREFERRED EMBODIMENTS

Figure 1:
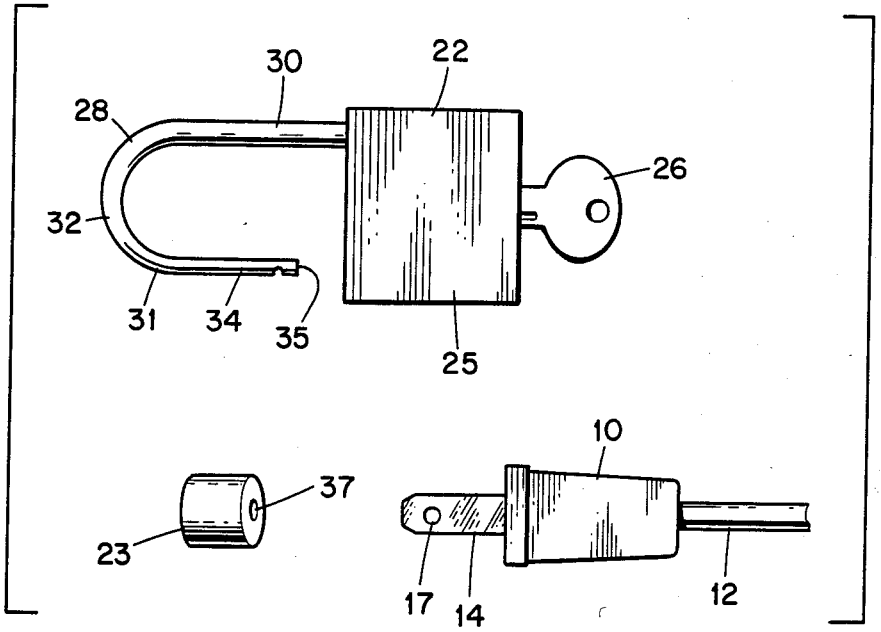
FIG. 1 is an exploded, side view of the locking device in an open position with the spacer removed from the lock shackle and rotated away from the prongs of the electrical plug.

Referring to the drawings, a conventional male electrical plug 10 has a cord 12 with a pair of flat conductive prongs 14 and 15 spaced approximately $\frac{3}{8}$ inch apart. As is commonly known in the prior art, the plug 10 is formed of molded plastic or rubber and the prongs 14 and 15 are attached to the cord's conductive wires therewithin. The prongs 14 and 15 each have an aperture 17 located approximately $\frac{1}{8}$ inch from the outward ends thereof. The apertures 17 have an approximate inner diameter of $\frac{1}{8}$ inch and, as seen FIG. 2, have centers aligned with one another along a common axis perpendicular to the opposed, flat surfaces of the prongs 14 and 15.

Figure 2:
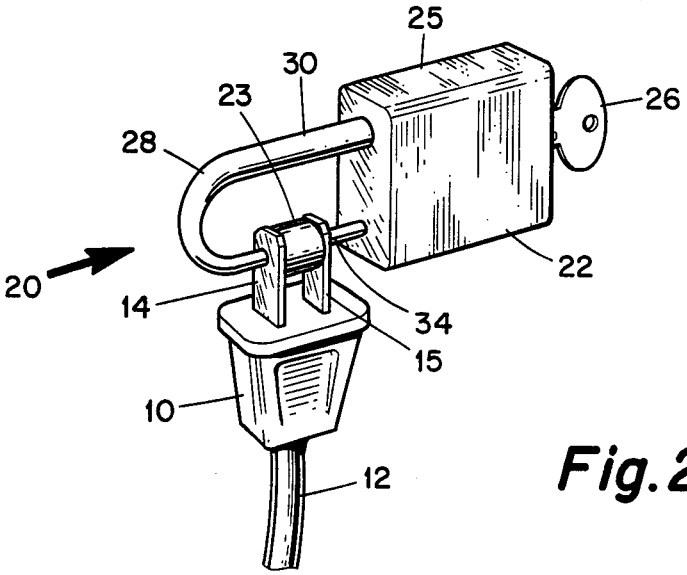
FIG. 2 is a perspective view of the locking device locked closed on the electrical plug.

The locking device 20 of this invention includes a padlock 22 and a nonconductive spacer 23. The padlock 22 has a housing 25 with a locking mechanism (not shown) located therewithin operated by a key 26 or other means known in the art and a shackle 28 movable between an open position (FIG. 1) and a closed, locked position (FIG. 2). The shackle 28 is U-shaped and has two spaced end portions 30 and 31 joined by a arcuate portion 32. The one end portion 30 of the shackle 28 is movably mounted for pivotal motion within the housing 25 and the other end portion 31 is a free end movable into and out of closed relationship with the lock housing 25 as the shackle 28 is locked and unlocked. The free end portion 31 has a reduced diameter section 34 extending to the outermost edge 35 thereof which has an outer diameter of approximately $\frac{1}{8}$ inch. As shown, the shackle section 34 has a smaller cross-sectional diameter than the remainder of the shackle 28.

The cylindrical spacer 23 is formed of electrically nonconductive material, such as plastic or rubber, is approximately $\frac{3}{8}$ inch long and has an outer cross-sectional diameter of approximately $\frac{1}{2}$ inch. Formed longitudinally therethrough is a bore 37 having an inner diameter of approximately $\frac{1}{8}$ inch. Note that the shackle end section 34 has a diameter slightly smaller than the diameter of the spacer bore 37 and the prong apertures 17 so that the shackle end section 34 may be freely inserted through the spacer bore 37 and the prong apertures 17.

To use the locking device 20, the spacer 23 is positioned between the plug prongs 14 and 15 with its longitudinal bore 37 aligned with the prong apertures 17. The shackle 28 is opened and the free end 31 thereof is inserted through one of the prong apertures 17, through the spacer bore 37 and through the other prong aperture 17 at the opposite side. Thereafter, the shackle 28 is rotated and closed to its locked position with the free end section 34 extending into the housing 25. When the lock is closed, only about $\frac{5}{8}$ inch of the free end section 34 extends from the housing 25, most of which is surrounded by the spacer 23 and the plug prongs 14 and 15 so that only a minimal portion of the reduced diameter shackle end section 34 is exposed. When locked, no portion of the plug prongs 14 and 15 can be inserted into a female receptacle (not shown) because the spacer 23 extends beyond the outward free ends of the plug prongs 14 and 15 as seen in FIG. 2.

Note the shackle may be of any shape so long as the size of the free end section of the shackle permits its insertion through the prong apertures and the spacer bore. Similarly, the spacer, which may be of any shape, should be of sufficient diameter to extend beyond the prong ends and should be of a length to substantially span the distance between the plug prongs thereby preventing insertion of the plug into an electrical outlet.

Industrial Applicability

From the foregoing, it should be apparent that the locking device provides a convenient, inexpensive and safe means for disabling an electrical plug to prevent insertion into a receptacle thereby barring unauthorized use of the electrical device to which the plug is attached.

Other aspects, objects and advantages of this invention can be obtained from a study of the drawings, the disclosure and the appended claims.

What is claimed is:

1. A locking device for preventing insertion of a male electrical plug into a receptacle, the plug having a pair of spaced prongs each defining an aperture spaced from its respective free end, the apertures having centers aligned along a common axis, the locking device including a lock having a housing with a locking mechanism and a shackle adapted to be moved between open and closed positions with the housing, the shackle being generally U-shaped and having two spaced end portions, one end portion being movably mounted to the housing and the other end portion being movable into and out of closed position with the housing, the combination comprising:

said other end portion of the shackle defining a section at the free end thereof with a cross-sectional diameter slightly less than the inner diameter of the prong apertures; and an electrically nonconductive spacer having a longitudinal bore extending therethrough adapted to receive said free end section of the shackle, whereby the plug is disabled when said spacer is placed between the prongs, said free end section is inserted through the prong apertures and said spacer bore, and the shackle is closed in locking engagement with the locking mechanism thereby preventing insertion of the prongs into a receptacle.

2. The locking device of claim 1 wherein said spacer has a cross-sectional diameter greater than twice the distance between the prong aperture center and the prong end.

3. The locking device of claim 2 wherein said free end section of the shackle has a cross-sectional diameter of approximately $\frac{1}{8}$ inch.

4. The locking device of claim 3 wherein said spacer has a cross-sectional diameter of approximately $\frac{1}{2}$ inch.

5. The locking device of claim 4 wherein the spacer bore has an inner diameter of approximately $\frac{1}{8}$ inch.

6. The locking device of claim 5 wherein said free end section extends approximately $\frac{5}{8}$ inch from the lock housing when the lock is closed.

7. The locking device of claim 6 wherein said free end section has a cross-sectional diameter less than the cross-sectional diameter of the remainder of the shackle.

8. A locking device for preventing insertion of a male electrical plug into a receptacle, the plug having a pair of prongs spaced approximately $\frac{3}{8}$ inch apart and each defining an aperture spaced approximately $\frac{1}{8}$ inch from its respective free end, the apertures having an inner diameter of approximately $\frac{1}{8}$ inch and having centers aligned along a common axis, the locking device including a lock having a housing with a locking mechanism and a shackle, the shackle being generally U-shaped and having two spaced end portions, one end portion being movably mounted to the housing and the other end portion being adapted to be moved into and out of closed position with the housing, the combination comprising:

said other end portion of the shackle having a reduced diameter section extending to the free end thereof with a cross-sectional diameter less than the inner diameter of said prong apertures and the remainder of the shackle; and an electrically nonconductive spacer having a longitudinal length of approximately $\frac{3}{8}$ inch, a crosssectional diameter of approximately $\frac{1}{2}$ inch, and a longitudinal bore having an inner diameter of approximately $\frac{1}{8}$ inch and being adapted to receive said reduced diameter section of the shackle, whereby the plug is disabled when said spacer is placed between the prongs, said other end section is inserted through the prong apertures and the spacer bore, and the shackle is closed in locking engagement with the locking mechanism thereby preventing insertion of the prongs into a receptacle.

9. The locking device of claim 8 wherein said reduced diameter section extends approximately $\frac{5}{8}$ inch from the lock housing when the lock is closed.

* * * * *